US010101001B2

(12) United States Patent
Reinprecht

(10) Patent No.: US 10,101,001 B2
(45) Date of Patent: Oct. 16, 2018

(54) HEADLIGHTS FOR MOTOR VEHICLES

(71) Applicant: ZIZALA LICHTSYSTEME GMBH, Wieselburg (AT)

(72) Inventor: Markus Reinprecht, Wieselburg (AT)

(73) Assignee: ZKW Group GmbH, Wieselburg an der Erlauf (AT)

( * ) Notice: Subject to any disclaimer, the term of this patent is extended or adjusted under 35 U.S.C. 154(b) by 318 days.

(21) Appl. No.: 14/898,188

(22) PCT Filed: May 26, 2014

(86) PCT No.: PCT/AT2014/050123
§ 371 (c)(1),
(2) Date: Dec. 14, 2015

(87) PCT Pub. No.: WO2014/205466
PCT Pub. Date: Dec. 31, 2014

(65) Prior Publication Data

US 2016/0146419 A1 May 26, 2016

(30) Foreign Application Priority Data

Jun. 25, 2013 (AT) ..... A 50417/2013

(51) Int. Cl.
*F21S 8/10* (2006.01)
*F21S 41/14* (2018.01)
(Continued)

(52) U.S. Cl.
CPC ..... *F21S 48/1757* (2013.01); *F21S 41/14* (2018.01); *F21S 41/143* (2018.01); *F21S 41/16* (2018.01);
(Continued)

(58) Field of Classification Search
CPC ..... F21S 48/1757; F21S 48/1145; F21S 48/1154; F21S 48/1195; F21S 48/1241; F21S 48/1747; F21S 48/1752
(Continued)

(56) References Cited

U.S. PATENT DOCUMENTS 4,868,718 A 9/1989 Davenport et al.
8,545,070 B2 10/2013 Sakiyama et al.
(Continued)

FOREIGN PATENT DOCUMENTS

CA 2717729 A1 9/2009
CN 101713514 A 5/2010
(Continued)

OTHER PUBLICATIONS

First Office Action dated Apr. 18, 2014 for Austrian priority application A 50417/2013.
(Continued)

*Primary Examiner* — Laura Tso
(74) *Attorney, Agent, or Firm* — Eversheds Sutherland (US) LLP

(57) ABSTRACT

A headlight for vehicles, having a plurality of light sources (5,13) and an optics (11) assigned to the light sources, in which a first lighting unit (1) having at least one light source (13) for generating a first, dynamically variable light effect and a second, laser lighting unit (4) having at least one laser light source (5), at least one beam defection unit (7) and at least one light conversion unit (8) are provided, and the optics (11) is configured to combine the two light effects generated by the first lighting unit and at the light conversion unit of the second laser lighting unit to form an overall light distribution on a carriageway.

9 Claims, 4 Drawing Sheets

Figure 1:
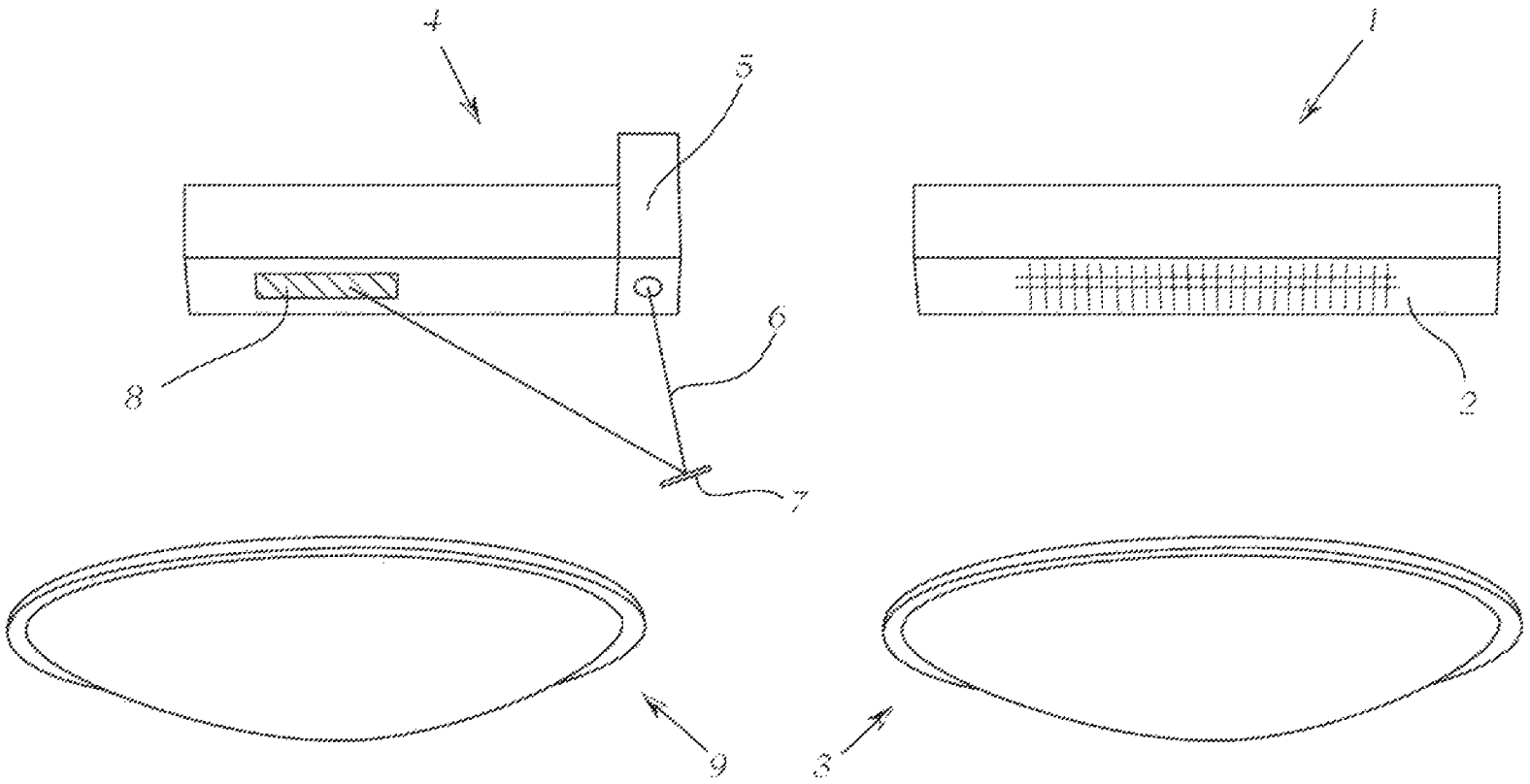

(51) Int. Cl.

| | |
|---|---|
| ***F21S 41/143*** | (2018.01) |
| ***F21S 41/24*** | (2018.01) |
| ***F21S 41/663*** | (2018.01) |
| ***F21S 41/67*** | (2018.01) |
| ***F21S 41/675*** | (2018.01) |
| ***F21S 41/16*** | (2018.01) |

(52) U.S. Cl.
CPC ..... *F21S 41/18* (2018.01); *F21S 41/24* (2018.01); *F21S 41/663* (2018.01); *F21S 41/67* (2018.01); *F21S 41/675* (2018.01)

(58) Field of Classification Search
USPC ..... 362/487–549
See application file for complete search history.

(56) References Cited

U.S. PATENT DOCUMENTS

| | | | | |
|---|---|---|---|---|
| 8,646,956 | B2 | 2/2014 | Hering et al. | |
| 8,807,809 | B2 | 8/2014 | Kloos | |
| 9,702,519 | B2 | 7/2017 | Reiners | |
| 2008/0013329 | A1* | 1/2008 | Takeda | F21K 9/00 362/459 |
| 2010/0080010 | A1 | 4/2010 | Marui et al. | |
| 2011/0249460 | A1* | 10/2011 | Kushimoto | B60Q 1/085 362/510 |
| 2012/0008098 | A1 | 1/2012 | Akiyama | |
| 2012/0275175 | A1 | 11/2012 | Kliebisch | |
| 2013/0027951 | A1 | 1/2013 | Takahashi et al. | |
| 2013/0058114 | A1 | 3/2013 | Reiners | |
| 2013/0265531 | A1* | 10/2013 | Mori | G02F 1/134309 349/106 |
| 2013/0335989 | A1* | 12/2013 | Sato | F21V 9/16 362/510 |

FOREIGN PATENT DOCUMENTS

| | | | |
|---|---|---|---|
| CN | 101959716 | A | 1/2011 |
| CN | 102046420 | A | 5/2011 |
| CN | 102734748 | A | 10/2012 |
| CN | 102939500 | A | 2/2013 |
| CN | 103032793 | A | 4/2013 |
| CN | 104848134 | A | 8/2015 |
| DE | 4006938 | A1 | 9/1990 |
| DE | 19737653 | A1 | 3/1999 |
| DE | 102007025337 | A1 | 12/2007 |
| DE | 102008013603 | A1 | 9/2009 |
| DE | 102008025397 | A1 | 12/2009 |
| DE | 102010028949 | A1 | 11/2011 |
| DE | 102011001865 | A1 | 10/2012 |
| DE | 102012008833 | A1 | 11/2012 |
| DE | 102011054234 | A1 | 4/2013 |
| EP | 1243467 | A2 | 9/2002 |
| EP | 2261083 | A1 | 12/2010 |
| EP | 2525140 | A2 | 11/2012 |
| EP | 2725293 | A1 | 4/2014 |
| EP | 2507545 | B1 | 2/2015 |
| EP | 2851611 | A2 | 3/2015 |
| FR | 2644120 | A1 | 9/1990 |
| GB | 2229263 | A | 9/1990 |
| JP | 2009-218211 | A | 9/2009 |
| JP | 2001-010403 | A | 1/2010 |
| JP | 2010-083211 | A | 4/2010 |
| JP | 2010-092747 | A | 4/2010 |
| JP | 2010-232044 | A | 10/2010 |
| JP | 5007362 | B2 | 8/2012 |
| JP | 2013-526759 | A | 6/2013 |
| JP | 5266605 | B2 | 8/2013 |
| JP | 5611941 | B2 | 10/2014 |
| JP | 2016-520189 | A | 7/2016 |
| KR | 20110013503 | A | 2/2011 |
| KR | 10-1503390 | B1 | 3/2015 |
| KR | 10-1805049 | B1 | 11/2017 |
| NL | 192512 | C | 9/1997 |
| WO | 2009/110477 | A1 | 9/2009 |
| WO | 2009/144024 | A1 | 12/2009 |
| WO | 2011/141377 | A1 | 11/2011 |
| WO | 2012/161170 | A1 | 11/2012 |
| WO | 2014/114417 | A1 | 7/2014 |

OTHER PUBLICATIONS

International Search Report and Written Opinion for International Application No. PCT/AT2014/050123 dated Oct. 9, 2014.
Communication (Art. 94(3)) for EP Patent Application No. 14738353.3 dated Jan. 3, 2017.
First Office Action dated Mar. 20, 2017 for CN 201480035836.3.

* cited by examiner

HEADLIGHTS FOR MOTOR VEHICLES

The invention relates to a headlight for vehicles, having a plurality of light sources and an optics assigned to the light sources.

A headlight of this type is known for example from US 2011/0249460 A1. In this headlight, apart from a conventional headlight module for a dipped beam distribution, there is also provided a scanning laser system, in which two laser beams deflected via moved micromirrors generate a light effect on a phosphor matrix, which light effect is projected by means of a lens onto a carriageway so as to generate there a dynamically variable light configuration.

In the case of a headlight disclosed in US 2008/0013329 A1 a two-dimensional laser element having separate, individually controllable light fields is provided, wherein each of the light fields is assigned a microlens of a microlens array placed in front, said microlens array projecting each generated light effect onto a carriageway.

In other headlights for generating dynamically variable light effects, as presented and described for example in DE 10 2008 013 603 A1 or in DE 10 2011 054 234 A1, an array of separate, individually controllable light sources, preferably LEDs, is provided, wherein each light source is assigned an individual optics or light guide in the form of a light conductor or a reflector. The light effect present at the light exit surface of the light guides is projected onto the carriageway by means of an optics, generally a lens.

On the other hand, light headlights are also known in which a central light source is provided, of which the light is projected into a carriageway via a plurality of light conductors and via special optics so as to generate a dynamically variable light distribution on said carriageway. For light distribution, digital light processors (DLPs) are sometimes used, as in U.S. Pat. No. 7,156,542 B2, or mechanically movable and thus selectively controllable light conductors, for example as in DE 40 06 938 A1.

Headlights of the specified type according to the prior art indeed enable a light pattern that can be dynamically adapted to the respective driving conditions, however there is an increased need for further functionalities in the case of adaptive front headlight systems, particularly with respect to main beam functions and a higher resolution of the light effect. Irrespective of these requirements, however, the production costs should lie within an acceptable range.

The object of the invention is therefore to create a headlight of the type in question which, at minimal cost, provides a high dynamic resolution, in particular in a long-distance range of the headlight illumination.

This object is achieved with a headlight rof the type specified in the introduction, in which, in accordance with the invention, a first lighting unit having at least one light source for generating a first, dynamically variable light effect and a second, laser lighting unit having at least one laser light source, at least one beam deflection unit and at least one light conversion unit are provided, and the optics is configured to combine the two light effects generated by the first lighting unit and at the light conversion unit of the second laser lighting unit to form an overall light distribution on a carriageway.

Thanks to the invention, a headlight is obtained which offers a high resolution, although the number of individual light sources lies within a scope that does not generate any problems either in terms of cost or in terms of the technical implementation, for example in respect of the cooling and the dimensions.

In accordance with a tried and tested embodiment the first lighting unit has a plurality of light sources and individual optics assigned to each of the light sources.

It may also be advantageous when the optics has two separate optics units, wherein the optics units are assigned one to each of the lighting units.

On the other hand, in view of a small overall size, it may be advisable when the optics has a single common optics unit, which is assigned to both lighting units.

In accordance with another useful variant the at least one optics unit is formed as a lens.

Particularly in view of service friendliness, it is useful when the at least one laser light source, the at least one beam deflection unit and the at least one light conversion unit of the laser lighting unit are combined in a structural unit.

In a very compact variant it is advantageous when the at least one light conversion unit of the laser lighting unit is provided on the first lighting unit in the region of the light exit surfaces thereof.

A variant that has proven its worth to an extremely large extent is characterised in that the at least one beam deflection unit is formed as micromirrors pivotable about at least one axis.

In view of a good adaptation of the light effect, is also advantageous when the first lighting unit has individual light sources arranged in at least two rows and a plurality of columns, wherein the individual light sources can be controlled in order to generate a dynamically variable light distribution on a carriageway.

The adaptation capability is likewise improved when the at least one beam deflection unit is configured to generate a dynamically variable light effect at the light conversion unit, said light effect consisting of segments that can be selectively illuminated.

Should the light sources of the first lighting unit be LEDs, there is a large selection in respect of the spectral light distribution and the light strengths with favourable pricing.

Figure 2:
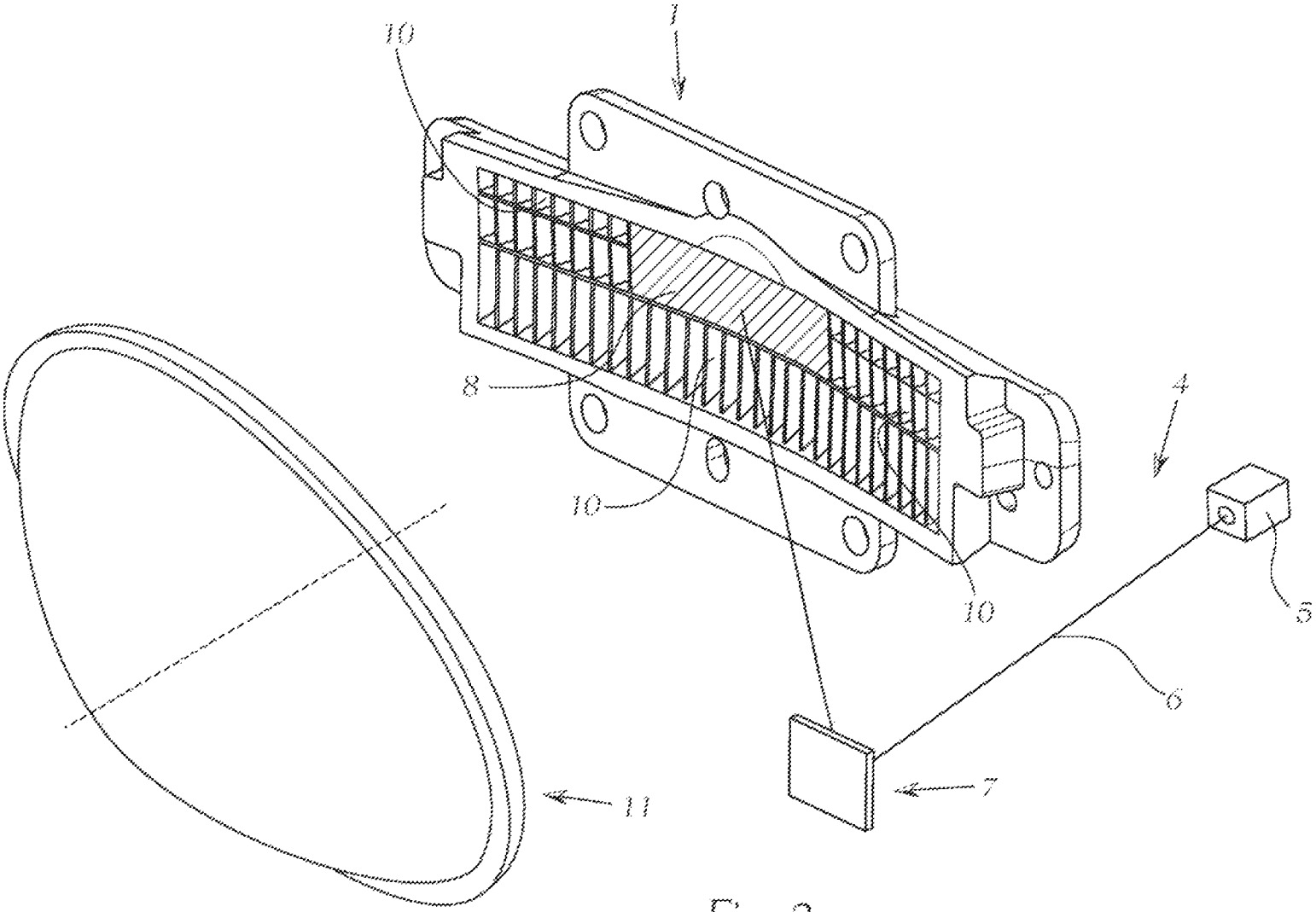
Figure 3:
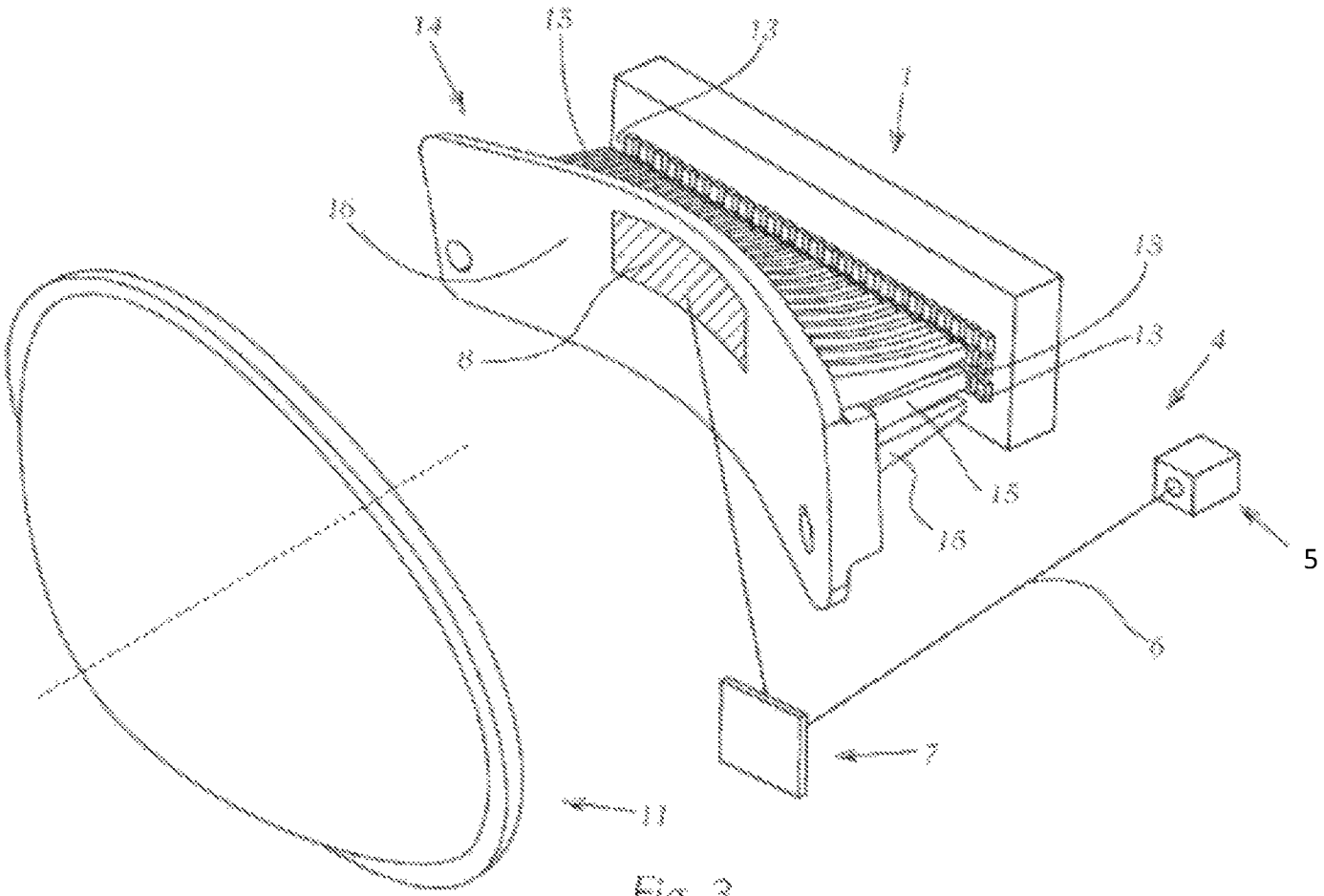
Figure 4:
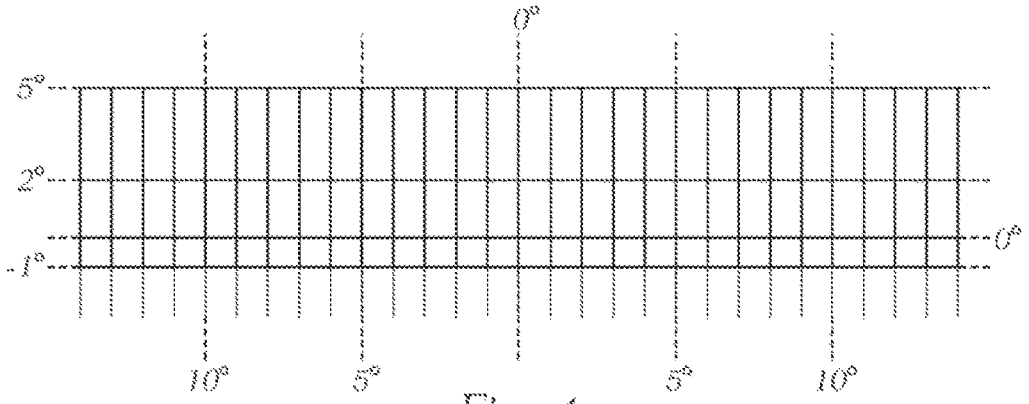
Figure 5:
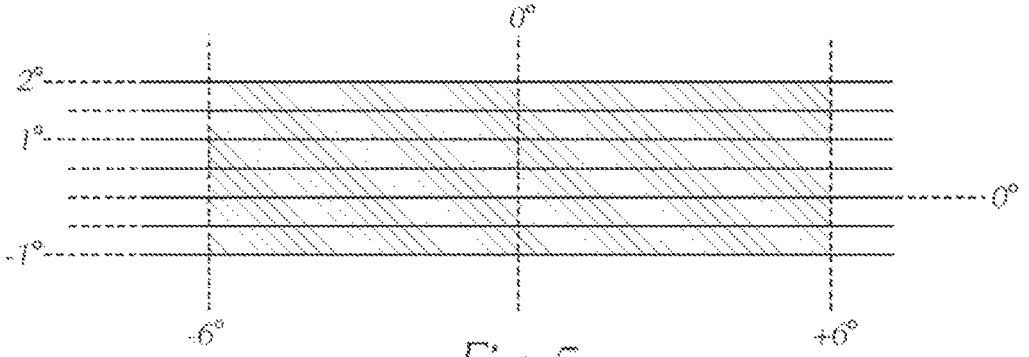
Figure 6:
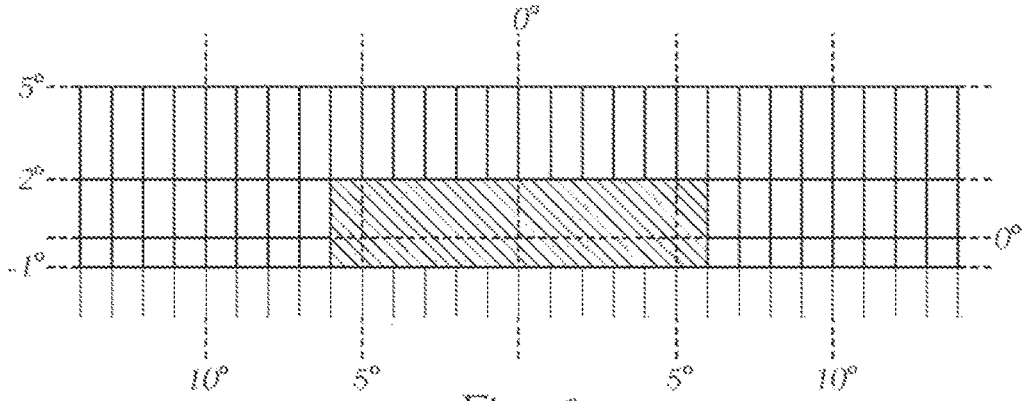

The invention together with further advantages will be explained in greater detail hereinafter on the basis of exemplary embodiments illustrated in the drawing, in which FIG. 1 schematically shows the main components of a headlight according to the invention in a first embodiment, FIG. 2 shows a second embodiment of a headlight according to the invention, FIG. 3 shows a first embodiment of a headlight according to the invention, FIG. 4 shows the light effect of the first lighting unit with a plurality of light sources, FIG. 5 shows the light effect of the second laser lighting unit, and FIG. 6 shows the overall light distribution composed of the light effects according to FIGS. 4 and 5.

Reference is made firstly to FIG. 1, which roughly schematically shows a first embodiment of the invention. In this figure and also in the following figures, merely those parts are illustrated that are essential for the function of the invention. Other parts well known to a person skilled in the art and also necessary for a headlight, such as a housing, adjustment devices, etc., have been omitted for the sake of clarity.

On the right-hand side of FIG. 1 a first lighting unit 1 can be seen, which, as presented and described further below in greater detail, has an array of individual light sources, in particular LEDs, which can be controlled separately or can be controlled individually in groups. These separate light sources are assigned individual optics, likewise not shown in this figure, which for example are formed in the manner of a light conductor or a reflector and at a light exit surface 2 generate a light effect, which can be projected onto the carriageway by means of an optics, here by means of a lens 3.

Furthermore, a second lighting unit, specifically a laser lighting unit 4, is provided, which is shown to the left in FIG. 1 and which as essential component parts has a laser light source 5, which generates a laser beam 6, a beam deflection unit 7, which is formed here as a micromirror, and a light conversion unit 8. Scanning laser lighting units of this type are known, wherein the laser beam 6 generates a predefinable light effect at the light conversion unit 8 by a micromirror of the beam deflection unit 7 pivoting about one or about two axes, said light effect likewise being projected onto the carriageway by means of a further optics, here a lens 9, and combining with the light effect generated by the first lighting unit 1 in order to form an overall light effect or an overall light distribution on the carriageway.

Although two lenses 3 and 9 are shown here, this is not intended to rule out the fact that other optics constructions can be used. A further optics, for example a lens, can be arranged down-stream of the two lenses 3 and 9, or optics which also utilise reflectors can be used.

The laser light source 5 may generate for example a laser beam 6 having blue light, which is converted at a phosphor of the light conversion unit 8 into white light. Although in this example only a single laser lighting unit 4 is shown, it is quite possible to use at least one further laser unit, which in turn guides the laser beam in a scanning manner to the light conversion unit 8 either via the same beam deflection unit or via a further beam deflection unit.

As can also be inferred from the prior art, it is possible to also apply the laser beam from behind to a phosphor layer of the light conversion unit, wherein the irradiation of the light converted into phosphor takes place from the front.

FIG. 2 shows a second embodiment of the invention, wherein the first lighting unit 1 is illustrated specifically in one of the preferred embodiments and like reference signs are also used for comparable parts. Individual optics 10, which here are formed as reflectors, can be seen on the front side of the first lighting unit 1, there being arranged light sources, preferably LEDs, at the base of said optics (not visible in FIG. 2). In the present case the lighting unit 1 has light sources arranged in three rows and 2×8 and 1×28 columns and an according number of individual optics 10 or reflectors. Here as well, a light conversion unit 8 is provided in the region of the light exit surface of the first lighting unit 1, over which light conversion unit a laser beam 6 generated by a laser light source 5 scans in a manner deflected by an oscillating micromirror of a beam deflection unit 7. Here, the laser lighting unit 4 is formed by the laser light source 5, the beam deflection unit 7 and the light conversion unit 8 arranged on the first lighting unit 1.

In contrast to the embodiment according to FIG. 1, an optics 11, specifically a lens, common to both lighting units 1 and 4 is provided and combines the light effect present at the exit surfaces of the optics 10 and the light effect determined by the scanning laser beam 6 at the light conversion unit 8 and can project these onto a carriageway.

FIG. 3 schematically shows a third embodiment of a headlight according to the invention, which in principle corresponds to that according to FIG. 2, wherein like reference signs are also used for comparable parts. The first lighting unit 1 consists here of a light source unit 12 having individual light sources 13, which are formed as LEDs and are arranged in three rows having 26 columns. This light source unit 12 and the individual light sources 13 is/are assigned a primary optics 14, which has a number of separate totally reflective light conductors 15 corresponding to the number of LEDs or light sources 13, here 78, which extend forwards and open out into a light exit surface 16. A light conversion unit 8 is in turn arranged at this light exit surface 16 and is scanned by the laser beam 6, wherein the monochromatic laser light is converted into a light that can be used for carriageway illumination (white light).

In the embodiments according to FIGS. 2 and 3 it can be seen that a number of light exit openings of the individual light sources are covered by the light conversion unit 8 having a corresponding phosphor surface. Here, it is possible for the spectral light distribution of the individual light sources 13 or LEDs in FIG. 3 to be coordinated with the phosphor of the light conversion unit 8, such that they shine therethrough or also excite it to light up, whereby the area for the illumination illustrated in FIGS. 2 and 3 is not "lost". However, it is also possible not to light up the corresponding region by the individual light sources, wherein the individual light sources can then also be omitted in this region.

Three light effects of a headlight according to the invention are illustrated in FIG. 4 to 6, wherein FIG. 4 shows the light effect of a first lighting unit alone, wherein the illumination extends in the vertical direction in this example from −1° to +5° and in the horizontal direction from 15° left to 15° right and a division into three rows, each having 28 columns, is provided. It should of course be clear that any divisions can be performed here and for example the same number of columns does not have to be provided in each row.

FIG. 5 now shows on an enlarged scale an exemplary light effect generated by the second laser lighting unit 4. Here, the regions in the horizontal direction are preferably from 6° left to 6° right and in the vertical direction preferably from −1° to +2°, since these regions offer the majority of impressions necessary for the driver for driving in the dark.

These two light effects are superimposed by the optics 3+9 or 11 and are combined to form an overall light effect projected onto the carriageway. A corresponding light effect is shown in FIG. 6, from which the combination of the light effects according to FIG. 4 and FIG. 5 can be seen, the functionality of the headlight being significantly increased by the additional illumination of the region illustrated in FIG. 5, since a high-resolution laser lighting unit can be used for this region, which unit for example enables a vertical resolution of 0.5° in the entire illumination region and 0.1° in the horizontal region.

The values specified hereinafter may further emphasise the advantages of the invention. The illumination maximum of the individual pixels produced by LEDs currently lies approximately at 80 to 100 lx, however this is relatively low for main beam. If the combination with the laser lighting unit is made, which likewise achieves the maximum of for example 80 to 100 lx, a main beam that at the main beam maximum offers an illumination of 180 to 200 lx is thus obtained, which meets the current requirements on good headlights.

Due to the superimposition of different light effects, colour effects can also be blurred and a more homogeneous uniformly coloured light effect can be generated.

The combination of both lighting units also makes it possible to arrive at a high dynamic resolution. Due to the relatively "rough" pixels of the first lighting unit 1, a relatively large area is covered, which is further divided by the high-resolution laser lighting unit 4. Very small regions can thus be controlled directly, such that the resolution of the overall system, as already mentioned, may be horizontally less than 0.1° and vertically less than 0.5°.

The specified numbers are merely examples, and even better values can be achieved by use of two-dimensional laser scanners of even higher resolution.

Of course, the regions in which the light effects can be combined can be designed arbitrarily in accordance with the respective requirements, wherein there is in no way any restriction to a main beam.

Due to the combination of the two lighting units it is also possible to dispense with the illumination by the laser lighting unit 4 at lower speeds, which is advantageous the safety reasons, since for example when a vehicle is stationary a light emitted by the laser lighting unit that could be dangerous or uncomfortable for individuals is not delivered.

Lastly, it should be stressed that a favourable price-performance ratio compared with headlights based merely on laser scanners is produced by the combination of the two lighting units.

The invention claimed is:

1. A headlight for vehicles comprising:

at least one optics (3, 9; 11);

a first lighting unit (1) comprising a plurality of individual light sources (13), which are arranged in at least two rows and a plurality of columns;

a second laser lighting unit (4) comprising at least one laser light source (5);

at least one beam deflection unit (7); and at least one light conversion unit (8), wherein the at least one optics (3, 9; 11) is configured to combine two light effects generated by the first lighting unit and the at least one light conversion unit of the second laser lighting unit to form an overall light distribution on a carriageway, wherein the at least one beam deflection unit (7) is formed as micromirrors pivotable about at least one axis, and wherein the plurality of individual light sources (13) are configured to be controlled to generate a dynamically variable light distribution on the carriageway.

2. The headlight of claim 1, wherein individual optics (10; 15) are assigned to each of the plurality of individual light sources.

3. The headlight of claim 1, wherein the at least one optics comprises a first optics unit assigned to the first lighting unit and a second optics unit assigned to the second laser lighting unit.

4. The headlight of claim 1, wherein the at least one optics comprises a single common optics unit (11), which is assigned to both the first lighting unit and the second laser lighting unit.

5. The headlight of claim 1, wherein the at least one optics (3, 9; 11) is formed as a lens.

6. The headlight of claim 1, wherein the at least one laser light source (5), the at least one beam deflection unit (7), and the at least one light conversion unit (8) of the second laser lighting unit (4) are combined in a structural unit.

7. The headlight of claim 1, wherein the at least one light conversion unit (8) of the second laser lighting unit (4) is provided on the first lighting unit (1) in a region of a light exit surface (16) thereof.

8. The headlight of claim 1, wherein the at least one beam deflection unit (7) is configured to generate a dynamically variable light effect at the at least one light conversion unit (8), comprises segments that are configured to be selectively illuminated.

9. The headlight of claim 1, wherein the plurality of individual light sources (13) of the first lighting unit (1) are LEDs.

* * * * *